US006195943B1

(12) United States Patent
Woods et al.

(10) Patent No.: US 6,195,943 B1
(45) Date of Patent: Mar. 6, 2001

(54) COLLAPSIBLE STAGE OR LIKE STRUCTURE

(75) Inventors: Carl Henry Woods, South Melbourne; David John Woods, Albert Park; Rushton Carl Woods, Staughton Vale, all of (AU)

(73) Assignee: Ezistage Pty Ltd. (AU)

( * ) Notice: Subject to any disclaimer, the term of this patent is extended or adjusted under 35 U.S.C. 154(b) by 0 days.

(21) Appl. No.: 09/367,279

(22) PCT Filed: Feb. 17, 1998

(86) PCT No.: PCT/AU98/00097

§ 371 Date: Aug. 16, 1999

§ 102(e) Date: Aug. 16, 1999

(87) PCT Pub. No.: WO98/37291

PCT Pub. Date: Aug. 27, 1998

(30) Foreign Application Priority Data

Feb. 18, 1997 (AU) ..... PO5145

(51) Int. Cl.[7] ..... E04H 3/26

(52) U.S. Cl. ..... 52/7; 52/69; 52/71

(58) Field of Search ..... 52/7, 69, 71, 182; 108/59, 65, 67, 70, 80, 81

(56) References Cited

U.S. PATENT DOCUMENTS

| | | | | |
|---|---|---|---|---|
| 2,978,754 | * | 4/1961 | Wilson | 52/7 |
| 3,152,833 | * | 10/1964 | Creveling | 108/81 |
| 3,624,782 | * | 11/1971 | La Habra | 414/793.4 |
| 3,999,491 | | 12/1976 | Wilson . | |
| 4,327,650 | | 5/1982 | Bue . | |
| 4,643,103 | * | 2/1987 | Jorgensen | 108/36 |
| 4,779,452 | | 10/1988 | Staten et al. . | |
| 4,917,217 | * | 4/1990 | Rogers | 182/152 |
| 5,335,604 | * | 8/1994 | Jiang | 100/119 |
| 5,392,718 | * | 2/1995 | Stevens | 108/167 |
| 5,613,450 | * | 3/1997 | Wagner | 108/175 |
| 5,615,451 | * | 4/1997 | Peterson | 16/34 |

FOREIGN PATENT DOCUMENTS

| | | |
|---|---|---|
| 16951/76 | 2/1978 | (AU) . |
| 93/03240 | 2/1993 | (WO) . |

* cited by examiner

*Primary Examiner*—Carl D. Friedman
*Assistant Examiner*—Kevin McDermott
(74) *Attorney, Agent, or Firm*—Larson & Taylor, PLC

(57) ABSTRACT

A collapsible stage (1) is provided which has a first planar wing (3), a second planar wing (5) and an intermediate planar section (7). The respective wings (3 to 5) are hinged to respective sides of the intermediate section (7) so they can both swing upwardly from a plane where they are co-planar with the intermediate section where they collectively form an open stage (1), to a collapsed position where both wings (3 to 5) are generally parallel to one another and extend upright. The intermediate section (7) has ground engaging devices (17) to permit rolling or sliding movement of the collapsed stage. A first pair of retractable legs (11) are connected with an underside of the first wing (3) adjacent one side of the intermediate section (7), and a second pair of retractable legs (13) are connected with an underside of the second wing (5) and the other side of the intermediate section (7). These legs (11 and 13) are guided by guide devices (21) attached to the intermediate section (7) so that feet on those legs will be below the ground engaging devices (17) when the wings (3 and 5) are swung so they are substantially co-planar with the intermediate section (7), and will be above the ground engaging devices (17) when the wings (3 and 5) are swung upwardly to the collapsed position. The outermost ends of the wings (3 and 5) each have further legs (35) swingably connected thereto which can be swung from a collapsed position where they extend substantially parallel to the planes of the respective wings (3 and 5) to erect positions where they are substantially perpendicular to the planes of the wings (3 and 5).

5 Claims, 5 Drawing Sheets

41
8
27
11
15
21
8
37
35
39
51
17
9
49
7
3
57
55
53
55
15
19
45
9
49
51
9
51
43
35
41
39
27
11
15
21
17

COLLAPSIBLE STAGE OR LIKE STRUCTURE

FIELD OF THE INVENTION

This invention relates to a collapsible stage or like structure and relates particularly but not exclusively to such in the stage renting arts.

DESCRIPTION OF PRIOR ART

Hitherto, in the stage renting arts, it has been common to provide portable stages for use at various venues. Typically, the stages are collapsible and or dismountable in order to provide for easy transport and economies of space in a transport vehicle. Generally, the dismantling and subsequent assembly processes are quite laborious.

BRIEF SUMMARY OF THE INVENTION

It is therefore an object of the present invention to provide a collapsible stage or like structure which is economic yet functional.

Therefore, according to a first broad aspect of the present invention there may be provided a collapsible stage or like structure having a floor. The floor comprises first plannar and second plannar outer wings and an intermediate plannar section. The first and second outer wings are swingably connected relative to intermediate section so that both first and second outer wings can swing upwardly from a plane where they are substantially co-plannar with said intermediate section, where they collectively form a stage or like structure floor, to a collapsed position where both first and second outer wings are generally parallel to one another and extend upright.

In this broad aspect, the intermediate section has ground engaging means thereon to permit rolling or sliding movement of a collapsed stage or like structure.

Also in this broad aspect there are: (a) a first pair of retractable legs swingably connected with an underside of first outer wing adjacent one side of intermediate section, and (b) a second pair of retractable legs swingably connected with an underside of second outer wing adjacent the otherside of intermediate section.

Further in this broad aspect, guide means are attached to intermediate section guiding each of retractable legs. Thus feet means on legs will be below ground engaging means when first and second outer wings are swung, so that they are substantially co-plannar with intermediate section and will be above ground engaging means when first and second outer wings are swung upwardly to collapsed position.

Still further in this broad aspect, the outermost regions of first and second outer wings each have further leg means swingably connected thereto. The leg means can be swung from collapsed positions where they extend substantially parallel to the planes of the respective first and second outer wings, to erect positions where they extend substantially perpendicular to the planes of the respective said first and said second outer wings.

It is particularly preferred that first pair of retractable legs be guided by guide means so they are always inclined relative to the plane of intermediate section. With this construction first pair of retractable legs crosses second pair underneath said intermediate section, so that feet means of first pair are disposed, when extended, to be closer to the side of intermediate section to which second outer wing is swingably attached than to the side to which first outer wing attaches. Thus feet of said second pair are disposed, when extended, to be closer to the side of intermediate section to which first outer wing is swingably attached than to the side to which second outer wing is attached.

It is also particularly preferred that there be link means swingably connected with further leg means and with trolley means which will cause the further leg means to swing to the collapsed positions when first and said second outer wings are swung to the collapsed position. Thus causes further leg means to swing to erect positions when first and second outer wings are swung to be substantially co-plannar with intermediate section.

BRIEF DESCRIPTION OF THE DRAWINGS

In order that the invention can be more clearly ascertained an example of a preferred embodiment will now be described with reference to the accompanying drawings wherein.

DETAILED DESCRIPTION OF PREFERRED EMBODIMENT

The stage 1 has a first plannar outer wing 3, a second plannar outer wing 5 and a plannar intermediate section 7.

Figures 1, 2, 3:
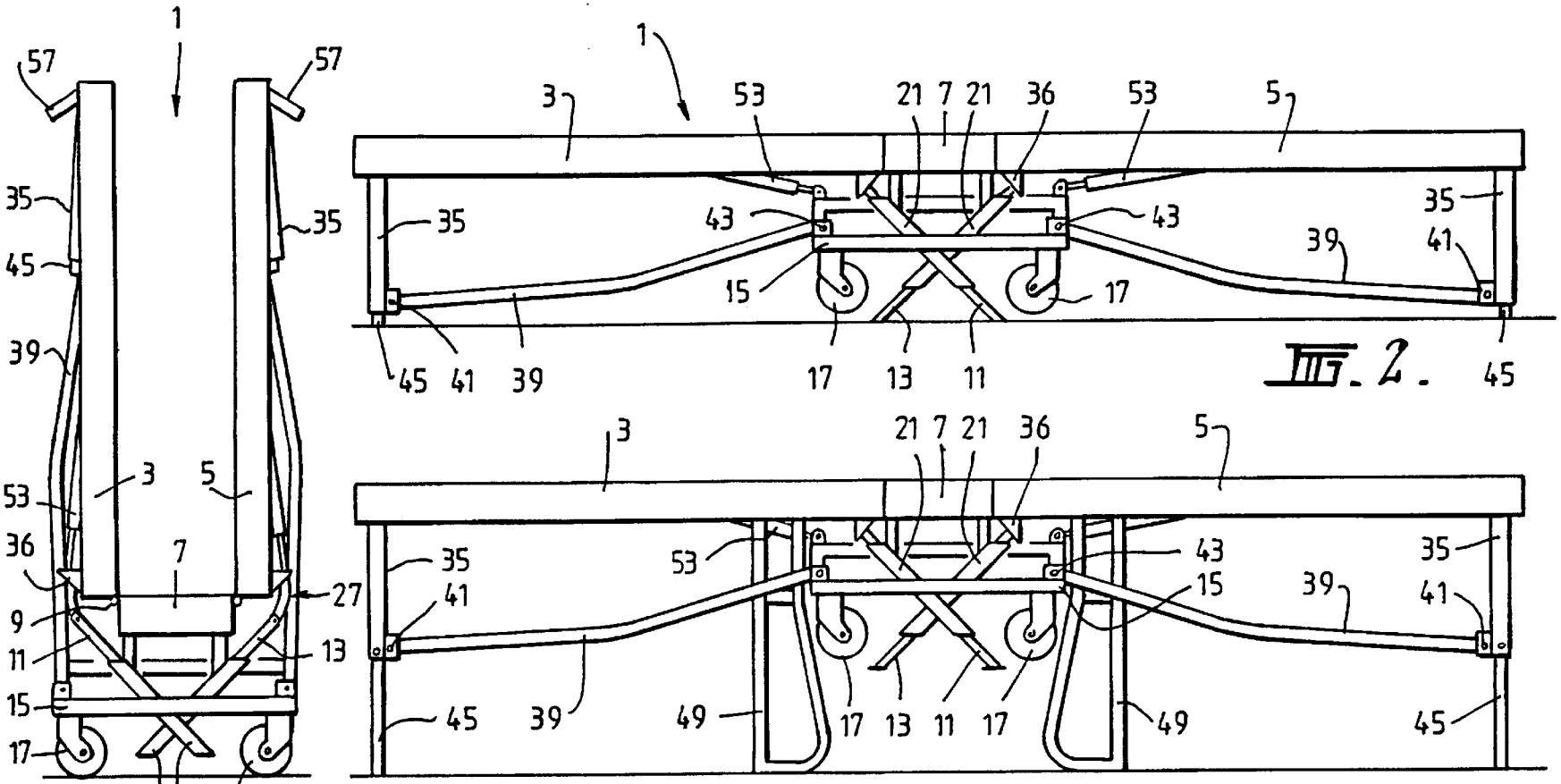
FIG. 1 is a front elevational view of a preferred collapsible stage in the collapsed position.
FIG. 2 is a view similar to that of FIG. 1 but showing the stage in an open ready for use position.
FIG. 3 is a view similar to that of FIG. 2 but showing a height extension of the stage.

FIG. 2 shows that the first wing, the second wing and the intermediate section are all co-planner when the stage is open and ready for use.

The material from which the first wing 3, second wing 5 and intermediate section 7 are made can include plywood or like material such as chipboard. Such material may be mounted to a metal peripheral frame for each of the first wing, second wing, and intermediate section 7. The metal frame is preferably fabricated from rectangular cross section tubular steel.

Figure 4:
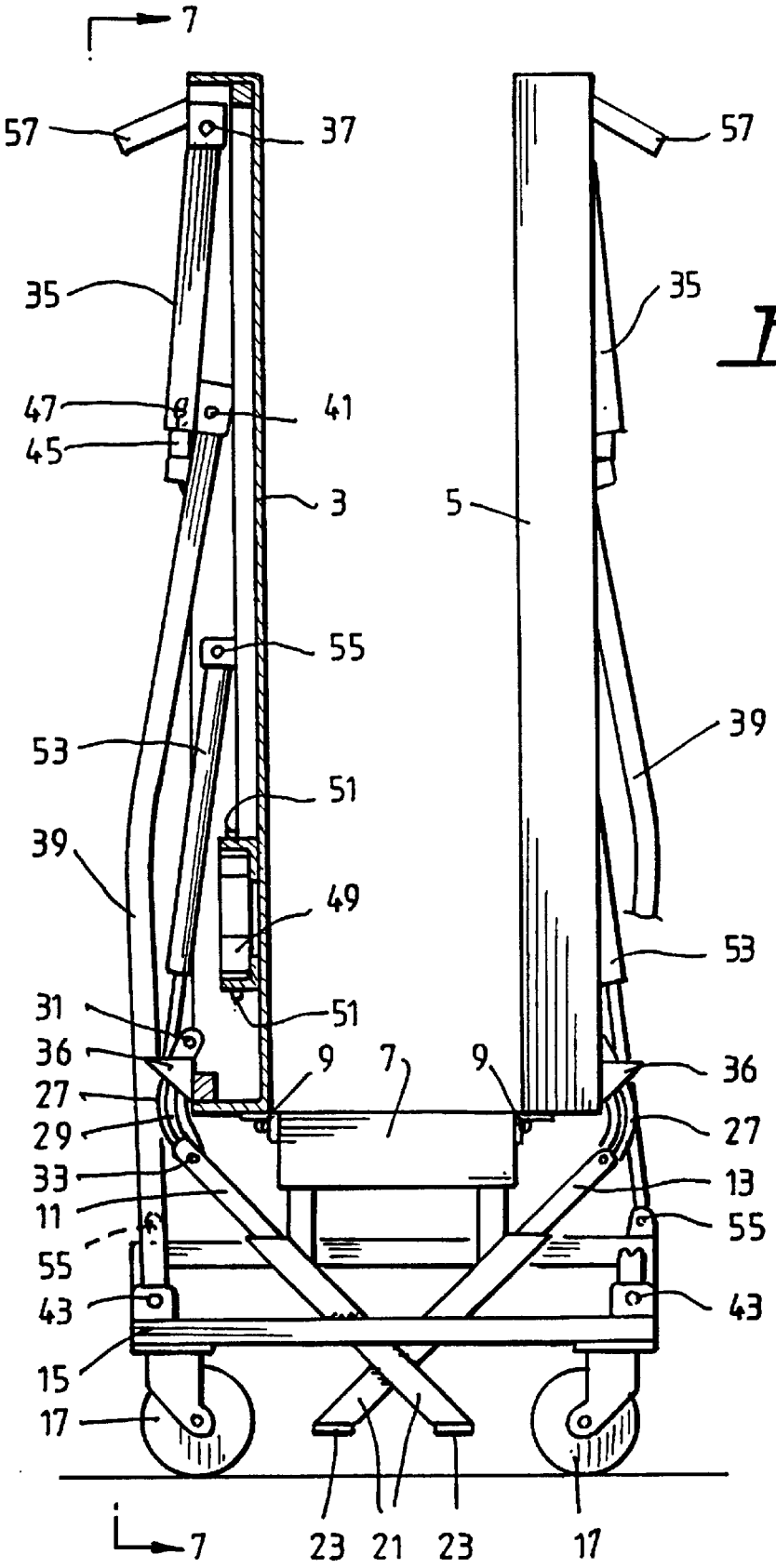
FIG. 4 is a view similar to that of FIG. 1, and in part section, but on an enlarged scale.

The first wing 3 is swingably supported relative to the intermediate section 7 by hinge means 9 (see FIG. 4). The hinge means 9 may be any convenient type hinge. FIG. 1 shows that the first wing 3 and the second wing 5 have been swung upwardly relative to the intermediate section 7 so that the first wing 3 and second wing 5 are substantially parallel to one another and extend upright.

There are a pair of first retractable metal legs 11 swingably connected with an underside of the first wing 3, and a second pair of retractable metal legs 13 swingably connected with an underside of the second wing 5. In both cases, the first and second pairs of retractable legs are connected adjacent respective sides of the intermediate section. One of the pair of legs 11 is at the front of the stage while the other pair of the legs 11 is at the rear of the stage. One of the pair of legs 13 is at the front of the stage while the other of the pair of legs 13 is at the rear of the stage.

Figure 7:
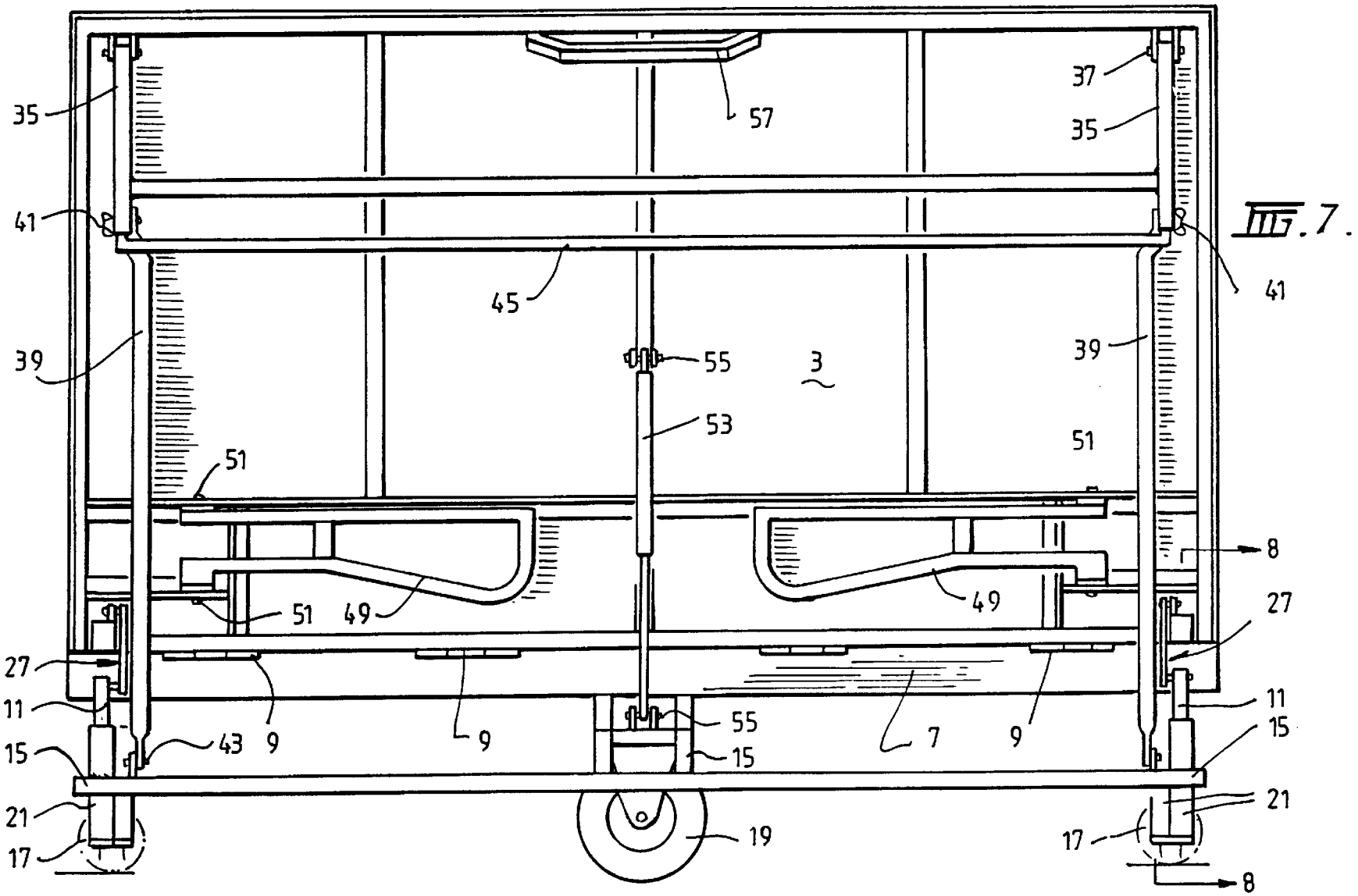
FIG. 7 is a view in the direction of arrow 7—7 of FIG. 4.

A rectangular shaped metal trolley frame 15 is provided and is attached to the underside of the intermediate sections 7. The trolley frame is suitably fastened relative to the intermediate section 7. The trolley frame 15 has ground engaging means 17 in the form of castor rollers 17. Four such rollers are provided at each of the corners of the trolley frame 15. FIG. 7 clearly shows the arrangement. Mounted centrally of the trolley frame 15 is a further pair of castor rollers 19 which are larger in diameter than caster rollers of the ground engaging means 17. Thus, when the stage is in the collapsed position as shown in FIG. 1, the ground engaging means 17 comprising the castor rollers 17 and 19 can be used for rolling the stage to required positions. Instead of using castor rollers or other wheels, skids may be provided to permit sliding movement of the stage.

The trolley frame 15 is provided with guide means 21 in the form of a rectangular tube. The tube is of steel and suitably welded to the trolley frame 15. The guide means 21 are inclined relative to the plane of the intermediate section 7. The arrangement is such that the first pair of retractable legs 11 will diagonally cross the second pair of legs 13 underneath the intermediate section 7. Accordingly, feet 23 on each of the legs 11 and 13 (see FIG. 4) extend to opposite sides of the intermediate section 7. In other words, the feet 23 of the legs 11 are disposed closer to the side of the intermediate section 7 to which the second wing 5 is swingably attached than the side to which the first wing 3 is attached. Similarly, the feet 23 of the legs 13 are disposed closer to the side of the intermediate section 7 to which the first wing 3 is swingably side than the side to which the second wing 5 is attached. This crossed arrangement provides for rigidity to the structure when the stage is in the open condition.

Figure 5:
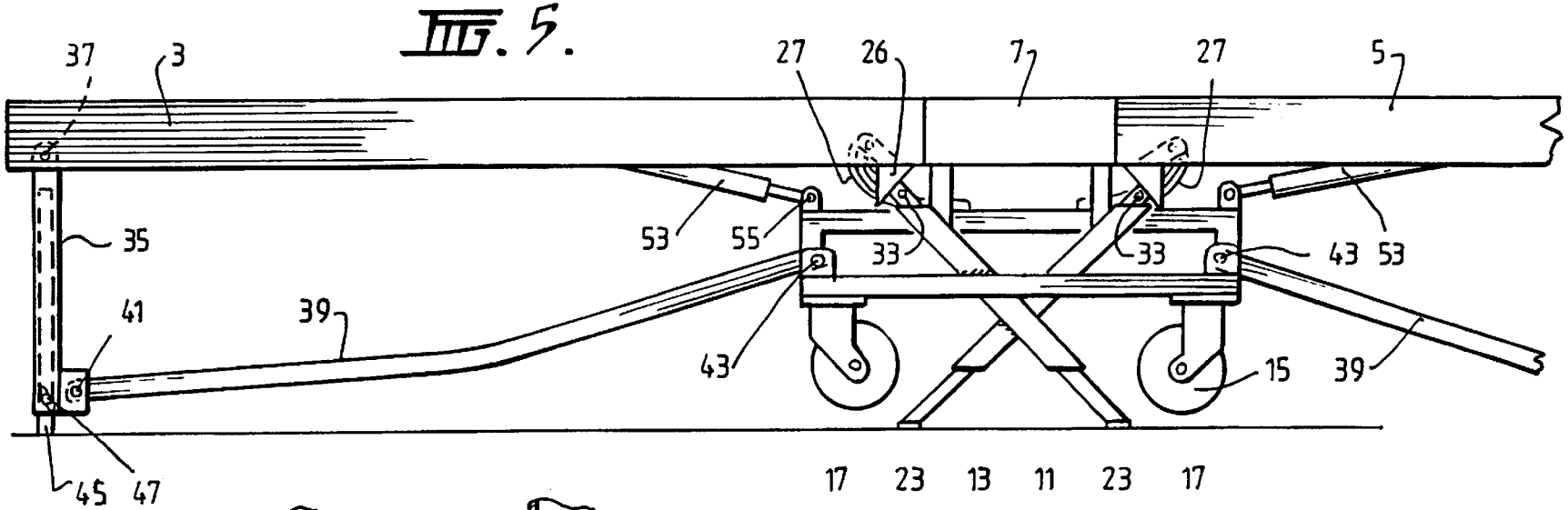
FIG. 5 is a view similar to that of FIG. 2 but showing on an enlarged scale only portion of the view shown in FIG. 2.

When the stage is opened ready for use, as shown in for example FIGS. 2 and 5, the feet 23 of the legs 11 and 13 are below the ground engaging means 17. Thus, the ground engaging means 17 are elevated relative to a ground surface on which the stage is then supported. When the stage is collapsed, the feet 23 retract in the guides 21 so that they are above the height of the ground engaging means 17 (as shown in FIG. 4) and therefore the stage in the collapsed position can be readily rolled to required positions.

Figure 9:
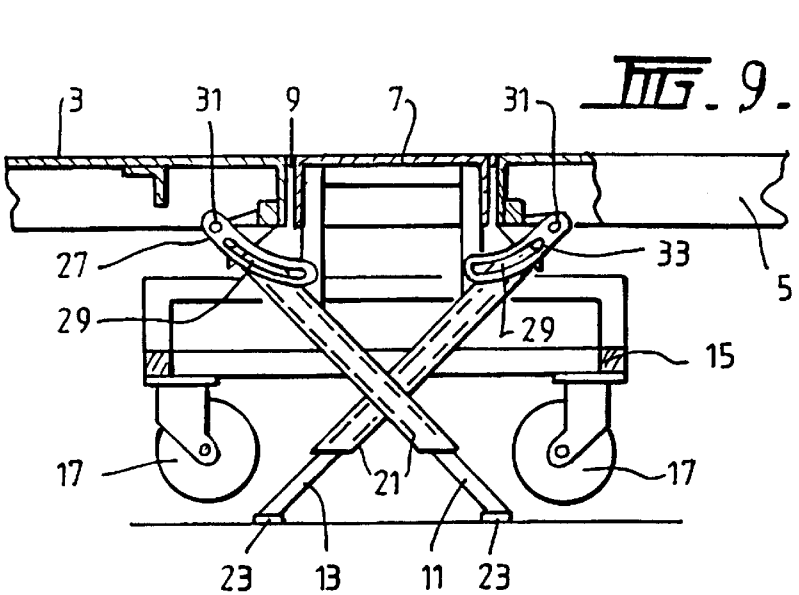
Figure 8:
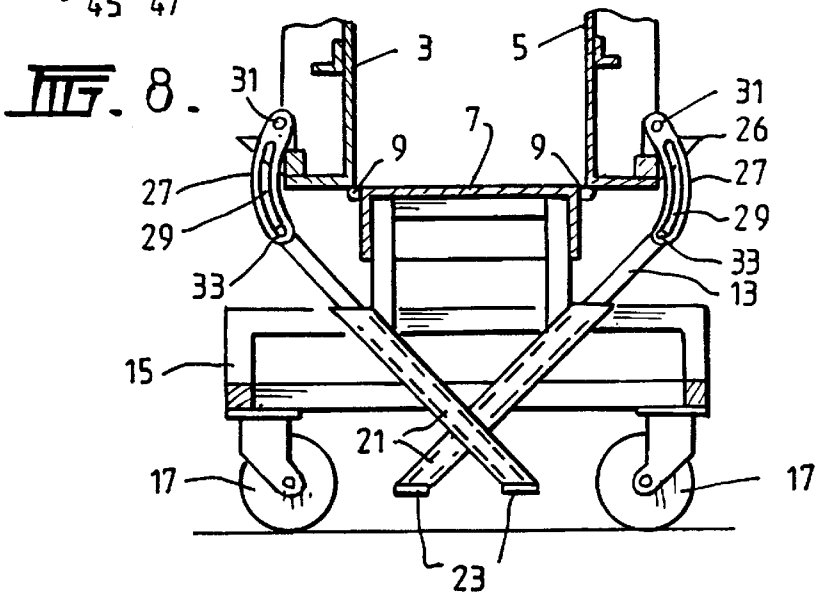
FIG. 8 is a detailed view in the direction of arrow 8—8 in FIG. 7 showing the stage in a collapsed position and, FIG. 9 is a view similar to that of FIG. 8 but showing the stage in an open ready for use position.

Each of the legs 11 and 13 is swingably connected to the under surface of the respective first wing 3 or second wing 5. This is clearly shown in FIGS. 4, 8, and 9. Such connection is via lost motion means 27. The lost motion means 27 comprises an arcuate metal plate with an arcuate slot 29 therein. One end of each arcuate plate is swingably connected to the respective frames of the first wing 3 or the second wing 5 by pivot pins 31. The uppermost ends of each of the arms 11 and 13 are provided with a respective pin 33 which locates within the respective arcuate slots 29 on the lost motion means 27. The pins 33 can be held captive relative to the slots 29 by means of washers and split pins such that the pins 33 cannot displace from the slots 29. The arrangement is such that when the respective first wing 3 and second wing 5 are swung to the collapsed position by swinging in an upward direction, the lost motion means 27 allows for the relative swinging motion whilst causing the respective legs 11 and 13 to retract within the respective guides 21 when the pins 33 reach the bottom ends of the arcuate slots 29. When the respective first wing 3 and second wing 5 are swung downwardly to an open, in use position respective triangular shaped wedges 36 attached to the wings 3 and 5 abut with the top ends of the legs 11 and 13 and push the legs in the guides 21 so the legs 11 and 13 move to the extended positions. When the wings 3 and 5 are fully opened the wedges 36 firmly bear on the top of the legs 11 and 13 and hold them in the extended position.

Figure 6:
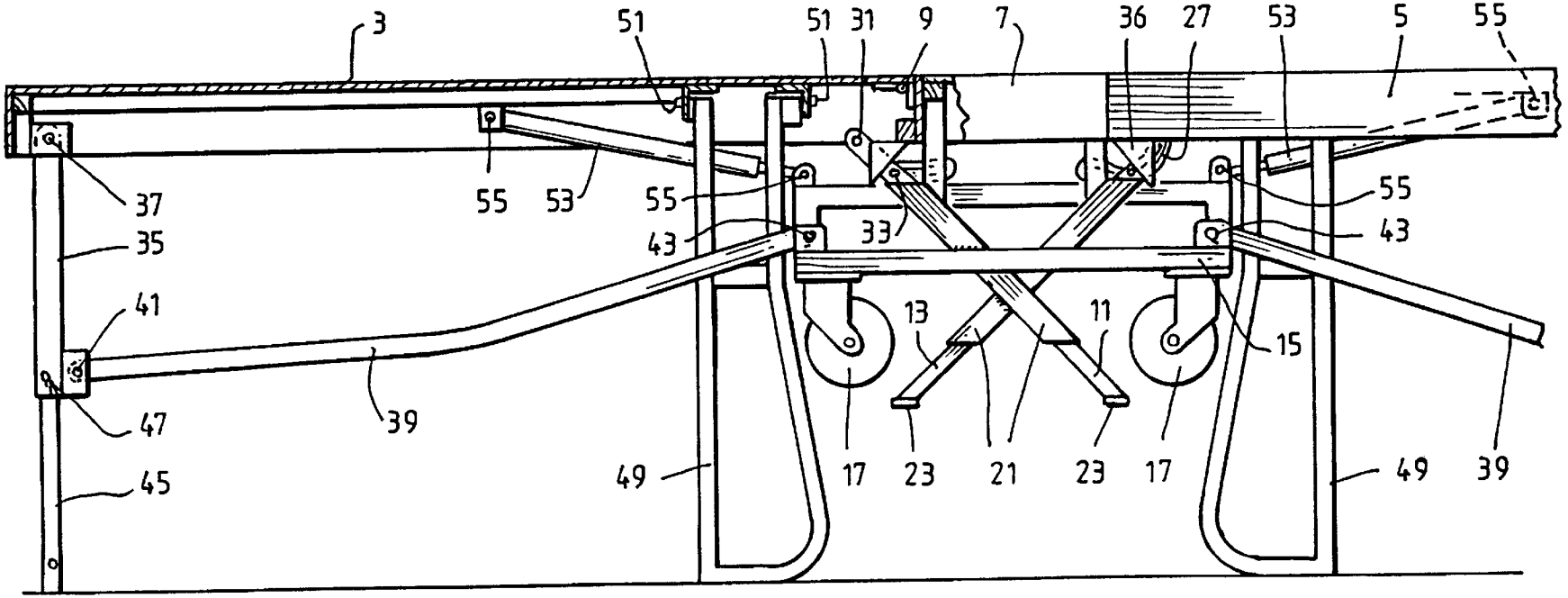
FIG. 6 is a view similar to that of FIG. 3 showing on an enlarged scale only a portion of that which is shown in FIG. 3 but where part is shown in cross section.

At the outer ends of each of the first wing 3 and second wing 5 there are provided further leg means 35. These further leg means 35 are preferably of hollow rectangular tube steel. The uppermost ends of the further leg means 35 are swingably connected to the respective first wing 3 and second wing 5 by pivot pins 37 (see FIG. 5). The bottom ends of the further legs 35 are connected with metal link arms 39. The link arms 39 are pivotably connected with the further legs 35 by pivot pins 41. The opposite ends of the link arms 39 are pivotably connected to the trolley frame 15 by pins 43. Thus, the link arms 39 cause the further legs 35 to swing about the respective pivot pins 37 so that when the stage is in the closed position, the legs extend substantially parallel with the plane of the respective first wings 3 and second wing 5. When the stage is open, the link arms 39 cause the respective further legs 35 to assume the upright position shown for example in FIGS. 5 and 6.

Each of the further leg means 35 has extendable and retractable metal legs 45. Pins 47 (see FIG. 6) can pass through openings in the further legs 35 and legs 45 in 20 cm increments of length adjustment of legs 45 relative to further legs 35 to positively hold the legs in the required extended positions.

Accordingly, the stage can be erected to a first standard height by merely unfolding the first wing and second wing. If the stage is required to be at a higher height from ground surface 25, then the legs 45 can be extended by 20 cm as shown for example in FIGS. 3 and 6. Here, auxiliary metal legs 49 can be swung from under the respective first wing 3 and second wing 5. In this case, each of the auxiliary legs 49 has a somewhat elongated "R" shape. The auxiliary legs are, in turn, swingably connected to a frame of each of the first wings 3 and second wing 5 by pivot pins 51. The axis of swinging is therefore parallel with the front of the stage and allows the auxiliary arms 49 to swing from a position where they lie generally parallel with the plane of each of the first wing 3 and second wing 5, to a position where they extend generally mutually perpendicular thereto underneath the stage. The auxiliary arms 49 may be arranged to swing against a physical stop (not shown) which is slightly over centre relative to the mutually perpendicular extended position. In this case, the auxiliary legs 49 will lock against that stop and provide rigidity to the legs in that extended position. Alternatively, as in the embodiment shown, the pivot connection through pins 51 is such that considerable force is required to manually swing each of the auxiliary legs 49. This, in turn, holds the legs in the extended position and resting against an adjacent link arm 39.

Gas strut pistons 53 can be connected to the under surface of the respective first wing 3 and second wing 5 and to the trolley frame 15 by suitable pivot link pins 55. The gas strut pistons 53 can be used to provide for controlled swinging movement of the fist wing 3 and second wing 5. A handle 57 (see FIG. 7 and also FIG. 4) may be provided at the outer ends of each of the first wing 3 and second wing 5 to permit easy user handling during swinging.

The arrangement provides for a stable stage when in the open condition and yet permits easy collapsing of the stage and subsequent transportation. The arrangement is such that the opening, installation, subsequent collapsing and removing of the stage can be effected by a single person.

Modifications may be made to the invention as would be apparent to persons skilled in the art of making collapsible structures. These and other modifications may be made without departing from the ambit of the invention the nature of which is to be determined from the aforegoing description.

What is claimed is:

1. A collapsible stage comprising:

a floor including first planar and second planar outer wings and an intermediate planar section, said first and said second outer wings being swingably connected to said intermediate section, so that both said first and second outer wings can swing upwardly from a plane where they are substantially co-planar with said intermediate section, where said first and second outer wings and intermediate section collectively form a stage floor, to a collapsed position where both said first and said second outer wings are generally parallel to one another and extend upright, said intermediate section having ground engaging means thereon to permit rolling or sliding movement when the first and second outer wings are in the collapsed condition, there being a first pair of retractable legs swingably connected with an underside of said first outer wing adjacent one side of said intermediate section and a second pair of retractable legs swingably connected with an underside of said second outer wing adjacent the other side of said intermediate section, guide means attached to said attached to said intermediate section guiding each of said retractable legs so that feet means of said legs (a) will be below said ground engaging means when said first and said second outer wings are swung to be substantially co-planar with said intermediate section and (b) will be above said ground engaging means when said first and said second outer wings are swung upwardly to said collapsed position, said first pair of retractable legs being guided by said guide means for sliding movement relative to said guide means so that said first pair of retractable legs crosses said second pair of retractable legs at said guide means underneath said intermediate section, so that said feet means of said first pair are disposed, when extended, to be closer to the side of said intermediate section to which said second outer wing is swingably attached than to the side to which said first outer wing attaches, and so that said feet means of said second pair are disposed, when extended, to be closer to the side of said intermediate section to which said first outer wing is swingably attached than to the side to which said second outer wing attaches, and the outermost side regions of said first and said second outer wings each having further leg means swingably connected thereto which can be swung (a) from collapsed positions where said further leg means extend substantially parallel to the planes of the respective said first and said second outer wings (b) to erect positions where said further leg means extend substantially perpendicular to the planes of the respective said first and said second outer wings.

2. A collapsible stage as claimed in claim 1, wherein a trolley frame is connected to the underside of said intermediate section, and wherein said ground engaging means is connected to said trolley frame.

3. A collapsible stage as claimed in claim 2, and further including link means swingably connected with said further leg means and with said trolley means which cause the further leg means to swing to the collapsed positions when said first and said second outer wings are swung to the collapsed position and which cause said further leg means to swing to said erect positions when said first and said second outer wings are swung to be substantially co-planar with said intermediate section.

4. A collapsible stage as claimed in claim 1, and further including respective first auxiliary legs swingably connected to said first wing and second auxiliary legs swingably connected to said second wing.

5. A collapsible stage as claimed in claim 2, and further including respective strut piston means connected to the respective undersurfaces of said first wing and said second wing and to said trolley frame to provide for respective controlled swinging of said first frame and said second frame.

* * * * *